US009085953B2

(12) United States Patent
Langeslag

(10) Patent No.: US 9,085,953 B2
(45) Date of Patent: Jul. 21, 2015

(54) DOWNHOLE FLOW CONTROL DEVICE AND METHOD

(75) Inventor: René Langeslag, Calgary (CA)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 13/443,358

(22) Filed: Apr. 10, 2012

(65) Prior Publication Data

US 2013/0098630 A1 Apr. 25, 2013

Related U.S. Application Data

(62) Division of application No. 12/136,377, filed on Jun. 10, 2008, now Pat. No. 8,171,999.

(60) Provisional application No. 61/052,919, filed on May 13, 2008.

(51) Int. Cl.
*E21B 34/06* (2006.01)
*E21B 43/10* (2006.01)

(52) U.S. Cl.
CPC ..... *E21B 34/06* (2013.01); *E21B 43/10* (2013.01)

(58) Field of Classification Search
CPC ..... E21B 34/06; E21B 43/10
USPC ..... 166/373, 227; 138/43, 46
See application file for complete search history.

(56) References Cited

U.S. PATENT DOCUMENTS 266,848 A 10/1882 Lewis
1,362,552 A 12/1920 Alexander et al.
1,488,753 A 4/1924 Kelly
1,580,325 A 4/1926 Leroy
1,649,524 A 11/1927 Hammond
1,915,867 A 6/1933 Penick
1,984,741 A 12/1934 Harrington
2,089,477 A 8/1937 Halbert (Continued)

FOREIGN PATENT DOCUMENTS

CN 1385594 12/2002
GB 1492345 6/1976

(Continued)

OTHER PUBLICATIONS

An Oil Selective Inflow Control System; Rune Freyer, Easy Well Solutions: Morten Fejerskkov, Norsk Hydro; Arve Huse, Altinex; European Petroleum Conference, Oct. 29-31, Aberdeen, United Kingdom, Copyright 2002, Society of Petroleum Engineers, Inc.

(Continued)

*Primary Examiner* — Robert E Fuller
(74) *Attorney, Agent, or Firm* — Cantor Colburn LLP

(57) ABSTRACT

A flow control device, including a first member defining a first portion of a flow path and a second member defining a second portion of the flow path. The flow path has a cross sectional flow area defined at least partially by the first member and the second member. A length of the flow path is greater than a largest dimension of the cross sectional flow area, and the cross sectional flow area is adjustable by movement of at least a portion of the first member relative to the second member. A crush zone arranged with at least one of the first member and the second member that can change in length due to loading thereof. A method of adjusting restriction of a flow path is also included.

16 Claims, 4 Drawing Sheets

(56) References Cited

U.S. PATENT DOCUMENTS

| | | | |
|---|---|---|---|
| 2,119,563 | A | 6/1938 | Wells |
| 2,214,064 | A | 9/1940 | Niles |
| 2,257,523 | A | 9/1941 | Combs |
| 2,391,609 | A | 12/1945 | Wright |
| 2,412,841 | A | 12/1946 | Spangler |
| 2,762,437 | A | 9/1956 | Egan et al. |
| 2,804,926 | A | 9/1957 | Zublin |
| 2,810,352 | A | 10/1957 | Tumlison |
| 2,814,947 | A | 12/1957 | Stegemeier et al. |
| 2,942,668 | A | 6/1960 | Maly et al. |
| 2,945,541 | A | 7/1960 | Maly et al. |
| 3,103,789 | A | 9/1963 | McDuff |
| 3,216,503 | A | 11/1965 | Fisher et al. |
| 3,240,274 | A | 3/1966 | Solum |
| 3,273,641 | A | 9/1966 | Bourne |
| 3,302,408 | A | 2/1967 | Schmid |
| 3,322,199 | A | 5/1967 | Van Note, Jr. |
| 3,326,291 | A | 6/1967 | Zandmer |
| 3,333,635 | A | 8/1967 | Crawford |
| 3,385,367 | A | 5/1968 | Kollsman |
| 3,386,508 | A | 6/1968 | Bielstein et al. |
| 3,399,548 | A | 9/1968 | Burns |
| 3,419,089 | A | 12/1968 | Venghiattis |
| 3,446,297 | A | 5/1969 | Elliott et al. |
| 3,451,477 | A | 6/1969 | Kelley |
| 3,468,375 | A | 9/1969 | States |
| 3,612,176 | A | 10/1971 | Bauer et al. |
| RE27,252 | E | 12/1971 | Sklar et al. |
| 3,675,714 | A | 7/1972 | Thompson |
| 3,692,064 | A | 9/1972 | Hohnerlein et al. |
| 3,739,845 | A | 6/1973 | Berry et al. |
| 3,791,444 | A | 2/1974 | Hickey |
| 3,876,235 | A | 4/1975 | Flint |
| 3,876,471 | A | 4/1975 | Jones |
| 3,918,523 | A | 11/1975 | Stuber |
| 3,951,338 | A | 4/1976 | Genna |
| 3,958,649 | A | 5/1976 | Bull et al. |
| 3,975,651 | A | 8/1976 | Griffiths |
| 4,153,757 | A | 5/1979 | Clark, III |
| 4,173,255 | A | 11/1979 | Kramer |
| 4,180,132 | A | 12/1979 | Young |
| 4,186,100 | A | 1/1980 | Mott |
| 4,187,909 | A | 2/1980 | Erbstoesser |
| 4,245,701 | A | 1/1981 | Chambers |
| 4,248,302 | A | 2/1981 | Churchman |
| 4,250,907 | A | 2/1981 | Struckman et al. |
| 4,257,650 | A | 3/1981 | Allen |
| 4,265,485 | A | 5/1981 | Boxerman et al. |
| 4,278,277 | A | 7/1981 | Krijgsman |
| 4,283,088 | A | 8/1981 | Tabakov et al. |
| 4,287,952 | A | 9/1981 | Erbstoesser |
| 4,332,401 | A | 6/1982 | Stephenson et al. |
| 4,390,067 | A | 6/1983 | Willman |
| 4,398,600 | A | 8/1983 | Vazquez |
| 4,398,898 | A | 8/1983 | Odom |
| 4,410,216 | A | 10/1983 | Allen |
| 4,415,205 | A | 11/1983 | Rehm et al. |
| 4,434,849 | A | 3/1984 | Allen |
| 4,463,988 | A | 8/1984 | Bouck et al. |
| 4,484,641 | A | 11/1984 | Dismukes |
| 4,491,186 | A | 1/1985 | Alder |
| 4,497,714 | A | 2/1985 | Harris |
| 4,512,403 | A | 4/1985 | Santangelo et al. |
| 4,552,218 | A | 11/1985 | Ross et al. |
| 4,552,230 | A | 11/1985 | Anderson et al. |
| 4,572,295 | A | 2/1986 | Walley |
| 4,576,404 | A | 3/1986 | Weber |
| 4,577,691 | A | 3/1986 | Huang et al. |
| 4,614,303 | A | 9/1986 | Moseley, Jr. et al. |
| 4,649,996 | A | 3/1987 | Kojicic et al. |
| 4,817,710 | A | 4/1989 | Edwards et al. |
| 4,821,800 | A | 4/1989 | Scott et al. |
| 4,856,590 | A | 8/1989 | Caillier |
| 4,899,835 | A | 2/1990 | Cherrington |
| 4,917,183 | A | 4/1990 | Gaidry et al. |
| 4,944,349 | A | 7/1990 | Von Gonten, Jr. |
| 4,974,674 | A | 12/1990 | Wells |
| 4,997,037 | A | 3/1991 | Coston |
| 4,998,585 | A | 3/1991 | Newcomer et al. |
| 5,004,049 | A | 4/1991 | Arterbury |
| 5,016,710 | A | 5/1991 | Renard et al. |
| 5,040,283 | A | 8/1991 | Pelgrom |
| 5,060,737 | A | 10/1991 | Mohn |
| 5,107,927 | A | 4/1992 | Whiteley et al. |
| 5,132,903 | A | 7/1992 | Sinclair |
| 5,156,811 | A | 10/1992 | White |
| 5,188,191 | A | 2/1993 | Tomek |
| 5,217,076 | A | 6/1993 | Masek |
| 5,333,684 | A | 8/1994 | Walter et al. |
| 5,337,821 | A | 8/1994 | Peterson |
| 5,339,895 | A | 8/1994 | Arterbury et al. |
| 5,339,897 | A | 8/1994 | Leaute |
| 5,355,956 | A | 10/1994 | Restarick |
| 5,377,750 | A | 1/1995 | Arterbury et al. |
| 5,381,864 | A | 1/1995 | Nguyen et al. |
| 5,384,046 | A | 1/1995 | Lotter et al. |
| 5,431,346 | A | 7/1995 | Sinaisky |
| 5,435,393 | A | 7/1995 | Brekke et al. |
| 5,435,395 | A | 7/1995 | Connell |
| 5,439,966 | A | 8/1995 | Graham et al. |
| 5,511,616 | A | 4/1996 | Bert |
| 5,551,513 | A | 9/1996 | Surles et al. |
| 5,586,213 | A | 12/1996 | Bridges et al. |
| 5,597,042 | A | 1/1997 | Tubel et al. |
| 5,609,204 | A | 3/1997 | Rebardi et al. |
| 5,673,751 | A | 10/1997 | Head et al. |
| 5,803,179 | A | 9/1998 | Echols et al. |
| 5,829,520 | A | 11/1998 | Johnson |
| 5,831,156 | A | 11/1998 | Mullins |
| 5,839,508 | A | 11/1998 | Tubel et al. |
| 5,873,410 | A | 2/1999 | Iato et al. |
| 5,881,809 | A | 3/1999 | Gillespie et al. |
| 5,896,928 | A | 4/1999 | Coon |
| 5,944,446 | A | 8/1999 | Hocking |
| 5,982,801 | A | 11/1999 | Deak |
| 6,044,869 | A | 4/2000 | Koob |
| 6,068,015 | A | 5/2000 | Pringle |
| 6,098,020 | A | 8/2000 | Den Boer |
| 6,112,815 | A | 9/2000 | Boe et al. |
| 6,112,817 | A | 9/2000 | Voll et al. |
| 6,119,780 | A | 9/2000 | Christmas |
| 6,182,755 | B1 | 2/2001 | Mansure |
| 6,228,812 | B1 | 5/2001 | Dawson et al. |
| 6,253,847 | B1 | 7/2001 | Stephenson |
| 6,253,861 | B1 | 7/2001 | Carmichael et al. |
| 6,273,194 | B1 | 8/2001 | Hiron et al. |
| 6,301,959 | B1 | 10/2001 | Hrametz et al. |
| 6,305,470 | B1 | 10/2001 | Woie |
| 6,325,152 | B1 | 12/2001 | Kelley et al. |
| 6,338,363 | B1 | 1/2002 | Chen et al. |
| 6,367,547 | B1 | 4/2002 | Towers et al. |
| 6,371,210 | B1 | 4/2002 | Bode et al. |
| 6,372,678 | B1 | 4/2002 | Youngman et al. |
| 6,419,021 | B1 | 7/2002 | George et al. |
| 6,474,413 | B1 | 11/2002 | Barbosa et al. |
| 6,505,682 | B2 | 1/2003 | Brockman |
| 6,516,888 | B1 | 2/2003 | Gunnarson et al. |
| 6,530,431 | B1 | 3/2003 | Castano-Mears et al. |
| 6,561,732 | B1 | 5/2003 | Bloomfield et al. |
| 6,581,681 | B1 | 6/2003 | Zimmerman et al. |
| 6,581,682 | B1 | 6/2003 | Parent et al. |
| 6,622,794 | B2 | 9/2003 | Zisk, Jr. |
| 6,632,527 | B1 | 10/2003 | McDaniel et al. |
| 6,635,732 | B2 | 10/2003 | Mentak |
| 6,667,029 | B2 | 12/2003 | Zhong et al. |
| 6,679,324 | B2 | 1/2004 | Den Boer et al. |
| 6,692,766 | B1 | 2/2004 | Rubinstein et al. |
| 6,699,503 | B1 | 3/2004 | Sako et al. |
| 6,699,611 | B2 | 3/2004 | Kim et al. |
| 6,712,154 | B2 | 3/2004 | Cook et al. |
| 6,722,437 | B2 | 4/2004 | Vercaemer et al. |
| 6,786,285 | B2 | 9/2004 | Johnson et al. |
| 6,817,416 | B2 | 11/2004 | Wilson et al. |
| 6,820,690 | B2 | 11/2004 | Vercaemer et al. |

(56) References Cited

U.S. PATENT DOCUMENTS

| | | | |
|---|---|---|---|
| 6,830,104 | B2 | 12/2004 | Nguyen et al. |
| 6,831,044 | B2 | 12/2004 | Constien |
| 6,840,321 | B2 | 1/2005 | Restarick et al. |
| 6,857,476 | B2 | 2/2005 | Richards |
| 6,863,126 | B2 | 3/2005 | McGlothen et al. |
| 6,896,049 | B2 * | 5/2005 | Moyes ..... 166/82.1 |
| 6,913,079 | B2 | 7/2005 | Tubel |
| 6,938,698 | B2 | 9/2005 | Coronado |
| 6,951,252 | B2 | 10/2005 | Restarick et al. |
| 6,959,764 | B2 | 11/2005 | Preston |
| 6,976,542 | B2 | 12/2005 | Henriksen et al. |
| 7,011,076 | B1 | 3/2006 | Weldon et al. |
| 7,032,675 | B2 | 4/2006 | Steele et al. |
| 7,059,410 | B2 | 6/2006 | Bousche et al. |
| 7,084,094 | B2 | 8/2006 | Gunn et al. |
| 7,159,656 | B2 | 1/2007 | Eoff et al. |
| 7,185,706 | B2 | 3/2007 | Freyer |
| 7,207,385 | B2 | 4/2007 | Smith et al. |
| 7,252,162 | B2 | 8/2007 | Akinlade et al. |
| 7,258,166 | B2 | 8/2007 | Russell |
| 7,264,047 | B2 | 9/2007 | Brezinski et al. |
| 7,290,606 | B2 | 11/2007 | Coronado et al. |
| 7,290,610 | B2 | 11/2007 | Corbette et al. |
| 7,318,472 | B2 | 1/2008 | Smith |
| 7,322,412 | B2 | 1/2008 | Badalamenti et al. |
| 7,325,616 | B2 | 2/2008 | Lopez De Cardenas et al. |
| 7,360,593 | B2 | 4/2008 | Constien |
| 7,367,399 | B2 | 5/2008 | Steele et al. |
| 7,395,858 | B2 | 7/2008 | Barbosa et al. |
| 7,398,822 | B2 | 7/2008 | Meijer et al. |
| 7,409,999 | B2 | 8/2008 | Henriksen et al. |
| 7,413,022 | B2 | 8/2008 | Broome et al. |
| 7,451,814 | B2 | 11/2008 | Graham et al. |
| 7,469,743 | B2 | 12/2008 | Richards |
| 7,581,593 | B2 | 9/2009 | Pankratz et al. |
| 7,621,326 | B2 | 11/2009 | Crichlow |
| 7,644,854 | B1 | 1/2010 | Holmes et al. |
| 7,647,966 | B2 | 1/2010 | Cavender et al. |
| 7,673,678 | B2 | 3/2010 | MacDougall et al. |
| 7,757,757 | B1 | 7/2010 | Vroblesky |
| 7,931,081 | B2 | 4/2011 | Sponchia |
| 2002/0020527 | A1 | 2/2002 | Kilaas |
| 2002/0125009 | A1 | 9/2002 | Wetzel et al. |
| 2002/0148610 | A1 | 10/2002 | Bussear et al. |
| 2002/0170717 | A1 | 11/2002 | Venning et al. |
| 2003/0221834 | A1 | 12/2003 | Hess et al. |
| 2004/0052689 | A1 | 3/2004 | Yao |
| 2004/0060705 | A1 | 4/2004 | Kelley |
| 2004/0094307 | A1 | 5/2004 | Daling et al. |
| 2004/0144544 | A1 | 7/2004 | Freyer |
| 2004/0159447 | A1 | 8/2004 | Bissonnette et al. |
| 2004/0194971 | A1 | 10/2004 | Thomson |
| 2004/0244988 | A1 | 12/2004 | Preston |
| 2005/0016732 | A1 | 1/2005 | Brannon et al. |
| 2005/0086807 | A1 | 4/2005 | Richard et al. |
| 2005/0126776 | A1 | 6/2005 | Russell |
| 2005/0178705 | A1 | 8/2005 | Broyles et al. |
| 2005/0189119 | A1 | 9/2005 | Gynz-Rekowski |
| 2005/0199298 | A1 | 9/2005 | Farrington |
| 2005/0207279 | A1 | 9/2005 | Chemali et al. |
| 2005/0241835 | A1 | 11/2005 | Burris et al. |
| 2005/0274515 | A1 | 12/2005 | Smith et al. |
| 2006/0032630 | A1 | 2/2006 | Heins |
| 2006/0042798 | A1 | 3/2006 | Badalamenti et al. |
| 2006/0048936 | A1 | 3/2006 | Fripp et al. |
| 2006/0048942 | A1 | 3/2006 | Moen et al. |
| 2006/0076150 | A1 | 4/2006 | Coronado et al. |
| 2006/0086498 | A1 | 4/2006 | Wetzel et al. |
| 2006/0108114 | A1 | 5/2006 | Johnson |
| 2006/0118296 | A1 | 6/2006 | Dybevik et al. |
| 2006/0124360 | A1 | 6/2006 | Lee et al. |
| 2006/0157242 | A1 | 7/2006 | Graham et al. |
| 2006/0175065 | A1 | 8/2006 | Ross |
| 2006/0185849 | A1 | 8/2006 | Edwards et al. |
| 2006/0250274 | A1 | 11/2006 | Mombourquette et al. |
| 2006/0272814 | A1 | 12/2006 | Broome et al. |
| 2006/0273876 | A1 | 12/2006 | Pachla et al. |
| 2007/0012444 | A1 | 1/2007 | Horgan et al. |
| 2007/0039741 | A1 | 2/2007 | Hailey, Jr. |
| 2007/0044962 | A1 | 3/2007 | Tibbles |
| 2007/0045266 | A1 | 3/2007 | Sandberg et al. |
| 2007/0056729 | A1 | 3/2007 | Pankratz et al. |
| 2007/0131434 | A1 | 6/2007 | MacDougall et al. |
| 2007/0181299 | A1 | 8/2007 | Chung et al. |
| 2007/0209799 | A1 | 9/2007 | Vinegar et al. |
| 2007/0246210 | A1 | 10/2007 | Richards |
| 2007/0246213 | A1 | 10/2007 | Hailey, Jr. |
| 2007/0246225 | A1 | 10/2007 | Hailey, Jr. et al. |
| 2007/0246407 | A1 | 10/2007 | Richards et al. |
| 2007/0272408 | A1 * | 11/2007 | Zazovsky et al. ..... 166/278 |
| 2007/0289749 | A1 | 12/2007 | Wood et al. |
| 2008/0035349 | A1 | 2/2008 | Richard |
| 2008/0035350 | A1 | 2/2008 | Henriksen et al. |
| 2008/0053662 | A1 | 3/2008 | Williamson et al. |
| 2008/0135249 | A1 | 6/2008 | Fripp et al. |
| 2008/0149323 | A1 | 6/2008 | O'Malley et al. |
| 2008/0149351 | A1 | 6/2008 | Marya et al. |
| 2008/0169099 | A1 | 7/2008 | Pensgaard |
| 2008/0236839 | A1 | 10/2008 | Oddie |
| 2008/0236843 | A1 | 10/2008 | Scott et al. |
| 2008/0251255 | A1 | 10/2008 | Forbes et al. |
| 2008/0283238 | A1 | 11/2008 | Richards et al. |
| 2008/0296023 | A1 | 12/2008 | Willauer |
| 2008/0314590 | A1 | 12/2008 | Patel |
| 2009/0056816 | A1 | 3/2009 | Arov et al. |
| 2009/0057014 | A1 | 3/2009 | Richard et al. |
| 2009/0071646 | A1 | 3/2009 | Pankratz et al. |
| 2009/0101330 | A1 | 4/2009 | Johnson |
| 2009/0101342 | A1 | 4/2009 | Gaudette et al. |
| 2009/0133869 | A1 | 5/2009 | Clem |
| 2009/0133874 | A1 | 5/2009 | Dale et al. |
| 2009/0139717 | A1 | 6/2009 | Richard et al. |
| 2009/0139727 | A1 | 6/2009 | Tanju et al. |
| 2009/0194282 | A1 | 8/2009 | Beer et al. |
| 2009/0205834 | A1 | 8/2009 | Garcia et al. |
| 2009/0301704 | A1 | 12/2009 | Dillett et al. |
| 2010/0126720 | A1 | 5/2010 | Kaiser et al. |
| 2011/0042096 | A1 | 2/2011 | Nutley et al. |

FOREIGN PATENT DOCUMENTS

| | | |
|---|---|---|
| GB | 2341405 | 3/2000 |
| JP | 59089383 | 5/1984 |
| SU | 1335677 | 8/1985 |
| WO | 9403743 | 2/1994 |
| WO | 0079097 | 12/2000 |
| WO | 0165063 | 9/2001 |
| WO | 0177485 | 10/2001 |
| WO | WO0192681 A1 | 12/2001 |
| WO | 02075110 | 9/2002 |
| WO | 2004018833 A1 | 3/2004 |
| WO | 2006015277 | 2/2006 |
| WO | 2008092241 A1 | 8/2008 |

OTHER PUBLICATIONS

Baker Hughes, Thru-Tubing Intervention, Z-Seal Technology, Z-Seal Metal-to-Metal Sealing Technology Shifts the Paradigm,http://www.bakerhughes.com/assets/media/brochures/4d121c2bfa7e1c7c9c00001b/file/30574tttintervention_catalog-1110.pdf.pdf&fs=4460520, 2010 pp. 79-81.

Baker Oil Tools, Product Report, Sand Control Systems: Screens, Equalizer CF Product Family No. H48688. Nov. 2005. 1 page.

Notification of Transmittal of the International Search Report and the Written Opinion of the International Searching Authority; PCT Application No. PCT/US2010/034747; Mailed Dec. 13, 2010; Korean Intellectualy Property Office.

Bercegeay, E. P., et al. "A One-Trip Gravel Packing System," SPE 4771, New Orleans, Louisiana, Feb. 7-8, 1974. 12 pages.

Burkill, et al. Selective Steam Injection in Open hole Gravel-packed Liner Completions SPE 5958.

(56) References Cited

OTHER PUBLICATIONS

Concentric Annular Pack Screen (CAPS) Service; Retrieved From Internet on Jun. 18, 2008. http://www.halliburton.com/ps/Default.aspx?navid=81&pageid=273&prodid=PRN%3a%3aIQSHFJ2QK.
Determination of Perforation Schemes to Control Production and Injection Profiles Along Horizontal; Asheim, Harald, Norwegian Institute of Technology; Oudeman, Pier, Koninklijke/Shell Exploratie en Producktie Laboratorium; SPE Drilling and Completion, vol. 12, No. 1, March; pp. 13-18; 1997 Society of Petroleum Engieneers.
Dikken, Ben J., SPE, Koninklijke/Shell E&P Laboratorium; "Pressure Drop in Horizontal Wells and Its Effect on Production Performance"; Nov. 1990, JPT; Copyright 1990, Society of Petroleum Engineers; pp. 1426-1433.
Dinarvand. R., D'Emanuele, A (1995) The use of thermoresponsive hydrogels for on-off release of molecules, J. Control. Rel. 36 221-227.
E.L. Joly, et al. New Production Logging Technique for Horizontal Wells. SPE 14463 1988.
Hackworth, et al. "Development and First Application of Bistable Expandable Sand Screen," Society of Petroleum Engineers: SPE 84265. Oct. 5-8 2003. 14 pages.
Henry Restarick, "Horizontal Completion Options in Reservoirs with Sand Problems". SPE 29831. Mar. 11-14, 1995. pp. 545-560.
Ishihara, K., Hamada, N., Sato, S., Shinohara, I., (1984) Photoinduced swelling control of amphiphdilic azoaromatic polymer membrane. J. Polym. Sci., Polm. Chem. Ed. 22: 121-128.
International Search Report and Written Opinion; Date of Mailing Jan. 13, 2011; International Appln No. PCT/US2010/034750; International Search Report 5 Pages; Written Opinion 3 Pages.
International Search Report and Written Opinion; Date of Mailing Jan. 27, 2011, International Appln No. PCT/US2010/034758; International Search Report 10 Pages; Written Opinion 3 Pages.
International Search Report; Date of Mailing Jan. 27, 2011; International Application No. PCT/US2010/034752; 3 Pages.
Mackenzie, Gordon ADN Garfield, Garry, Baker Oil Tools, Wellbore Isolation Intervention Devices Utilizing a Metal-to-Metal Rather Than an Elastomeric Sealing Methodology, SPE 109791, Society of Petroleum Engineers, Presentation at the 2007 SPE Annual Technical Conference and Exhibition held in Anaheim, California, U.S.A., Nov. 11-14, 2007, pp. 1-5.
Mathis, Stephen P. "Sand Management: A Review of Approaches and Conerns," SPE 82240, The Hague, The Netherlands, May 13-14, 2003. 7 pages.
Optimization of Commingled Production Using Infinitely Variable Inflow Control Valves; M.M, J.J. Naus, Delft University of Technology (DUT), Shell International Exploration and production (SIEP); J.D. Jansen, DUT and SIEP; SPE Annual Technical Conference and Exhibtion, Sep. 26-29 Houston, Texas, 2004, Society of Patent Engineers.
Pardo, et al. "Completion, Techniques Used in Horizontal Wells Drilled in Shallow Gas Sands in the Gulf of Mexio". SPE 24842. Oct. 4-7, 1992.
R. D. Harrison Jr., et al. Case Histories: New Horizontal Completion Designs Facilitate Development and Increase Production Capabilites in Sandstone Reservoirs. SPE 27890. Wester Regional Meeting held in Long Beach, CA Mar. 23-25, 1994.
"Rapid Swelling and Deswelling of Thermoreversible Hydrophobically Modified Poly (N-Isopropylacrylamide) Hydrogels Prepared by freezing Polymerisation", Xue, W., Hamley, I.W. and Huglin, M.B., 2002, 43(1) 5181-5186.
International Search Report and Written Opinion, Mailed Feb. 2, 2010, International Appln. No. PCT/US2009/049661, Written Opinion 7 Pages, International Search Report 3 Pages.
Tanaka, T., Nishio, I., Sun, S.T., Uena-Nisho, S. (1982) Collapse of gels in an electric field, Science, 218-467-469.
Tanaka, T., Ricka, J., (1984) Swelling of Ionic gels: Quantitative performance of the Donnan Thory, Macromolecules, 17, 2916-2921.
"Thermoreversible Swelling Behavior of Hydrogels Based on N-Isopropylacrylamide with a Zwitterionic Comonomer". Xue, W., Champ, S. and Huglin, M.B. 2001, European Polymer Journal, 37(5) 869-875.

* cited by examiner

DOWNHOLE FLOW CONTROL DEVICE AND METHOD

CROSS REFERENCE TO RELATED APPLICATIONS

This application is a Divisional of U.S. Non Provisional application Ser. No. 12/136,377, filed on Jun. 10, 2008, and claims priority to U.S. Provisional Application No. 61/052,919, filed on May 13, 2008, which patent applications are incorporated herein by reference in their entireties.

BACKGROUND

The following disclosure relates to a method and system for equalizing recovery of hydrocarbons from wells with multiple production zones having varying flow characteristics.

In long wells with multiple producing zones, the temperatures can vary between the zones thereby having an effect on the production rate and ultimately the total production from the various zones. For example, a high flowing zone can increase in temperature due to the friction of fluid flowing therethrough with high velocity. Such an increase in fluid temperature can decrease the viscosity of the fluid, thereby tending to further increase the flow rate. These conditions can result in depletion of hydrocarbons from the high flowing zones, while recovering relatively little hydrocarbon fluid from the low flowing zones. Systems and methods to equalize the hydrocarbon recovery rate from multi-zone wells would therefore be well received in the art.

BRIEF DESCRIPTION OF THE INVENTION

A flow control device, including a first member defining a first portion of a flow path; a second member defining a second portion of the flow path, the flow path having a cross sectional flow area defined at least partially by the first member and the second member, a length of the flow path being greater than a largest dimension of the cross sectional flow area, and the cross sectional flow area being adjustable by movement of at least a portion of the first member relative to the second member; and a crush zone arranged with at least one of the first member and the second member that can change in length due to loading thereof.

A method of adjusting restriction of a downhole flow path, including porting fluid through the downhole flow path, the downhole flow path having a length greater than a largest dimension of a cross sectional area of the downhole flow path; moving at least a portion of one of a first member defining a first portion of the downhole flow path and a second member defining a second portion of the downhole flow path relative to the other of the first member and the second member such that the cross sectional area is altered; and loading a crush zone arranged with at least one of the first member and the second member for changing an alterable length of the crush zone.

BRIEF DESCRIPTION OF THE DRAWINGS

The following descriptions should not be considered limiting in any way. With reference to the accompanying drawings, like elements are numbered alike.

DETAILED DESCRIPTION OF THE INVENTION

A detailed description of one or more embodiments of the disclosed apparatus and method are presented herein by way of exemplification and not limitation with reference to the Figures.

Figure 1:
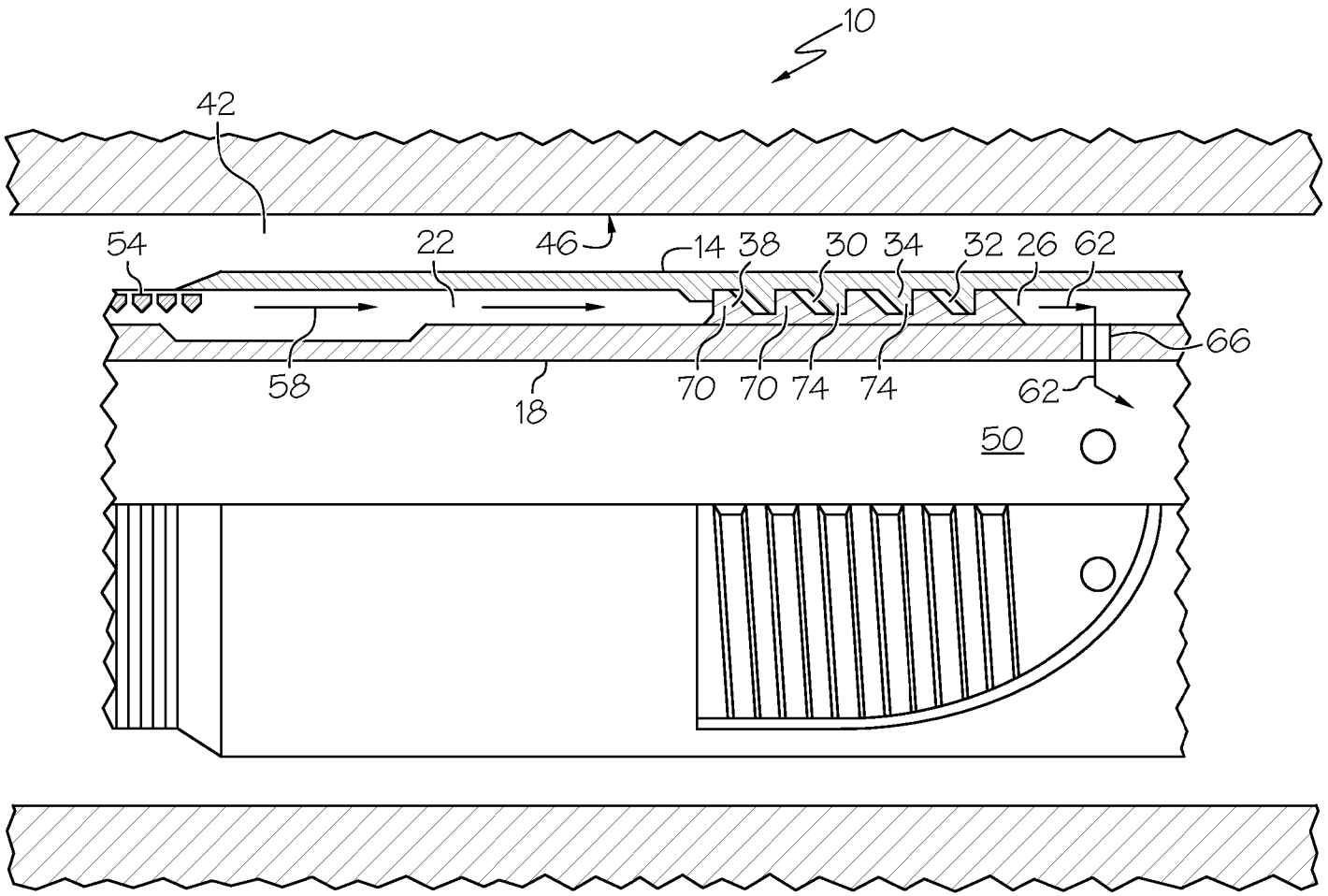
FIG. 1 depicts a partial cross sectional side view of a downhole flow control device disclosed herein.

Referring to FIG. 1, an embodiment of a downhole flow control device 10, disclosed herein, is illustrated. The control device 10 includes, a first tubular member 14 and a second tubular member 18 defining a first annular flow space 22 and a second annular flow space 26 therebetween. A helical flow path 30 fluidically connects the first annular flow space 22 with the second annular flow space 26. The helical flow path 30, has a cross sectional flow area 32, defined by clearance between helical radially inwardly protruding threads 34, of the first tubular member 14, and helical radially outwardly protruding threads 38, of the second tubular member 18. The cross sectional flow area 32 of the helical flow path 30 is adjustable such that the flow rate therethrough can be throttled. The adjustment can be performed automatically based upon downhole conditions such as flow rate and temperature, for example. Employing multiple helical flow paths 30 in a single tubular string can automatically reduce production in high flowing zones, while not reducing production in low flowing zones automatically to equalize the zones and potentially extract more total hydrocarbon from the well.

In the embodiment of FIG. 1, the first annular flow space 22 is fluidically connected to an annular space 42 between the first tubular member 14 and an inner perimetrical surface 46 of a formation, liner or other tubular structure, for example. The second annular flow space 26 is fluidically connected to an inner flow space 50 defined by an inner radial portion of the second tubular member 18. As such, fluid is permitted to flow through a screen 54, through the first annular flow space 22, in the direction of arrows 58, through the flow path 30, through the second annular flow space 26, in the direction of arrows 62 and through a port 66 into the inner flow space 50. It should be noted that in alternate embodiments the fluid that flows through the helical flow path 30 could originate from and end up in alternate locations or directions than those illustrated herein.

The helical flow path 30 can be designed to circumnavigate the second tubular member 18 as many times as desired with the flow path 30 illustrated herein, completing approximately four complete revolutions. A length of the flow path 30 is, therefore, much greater than a largest dimension of the cross sectional flow area 32. As such, viscous drag along surfaces that define the cross sectional flow area 32 create a pressure drop as fluid flows therethrough. This pressure drop can be substantial, particularly in comparison to the pressure drop that would result from the cross sectional flow area 32 if the length of the flow path 30 were less than the largest dimension of the cross sectional flow area 32. Embodiments disclosed herein allow for adjustment of the cross sectional flow area 32 including automatic adjustment of the cross sectional flow area 32 as will be discussed in detail with reference to the figures.

Additionally, the first tubular member 14 is axially movable relative to the second tubular member 18. As the first tubular member 14 is moved leftward as viewed in FIG. 1, the cross sectional flow area 32 will decrease since the threads 34 will move closer to the threads 38. One or more seals (not shown) seal the opposing ends of threads 34 to threads 38 to prevent fluid flow from flowing through any clearance developed on the back sides of the threads 34, 38 when the first tubular 14 is moved.

Figure 2:
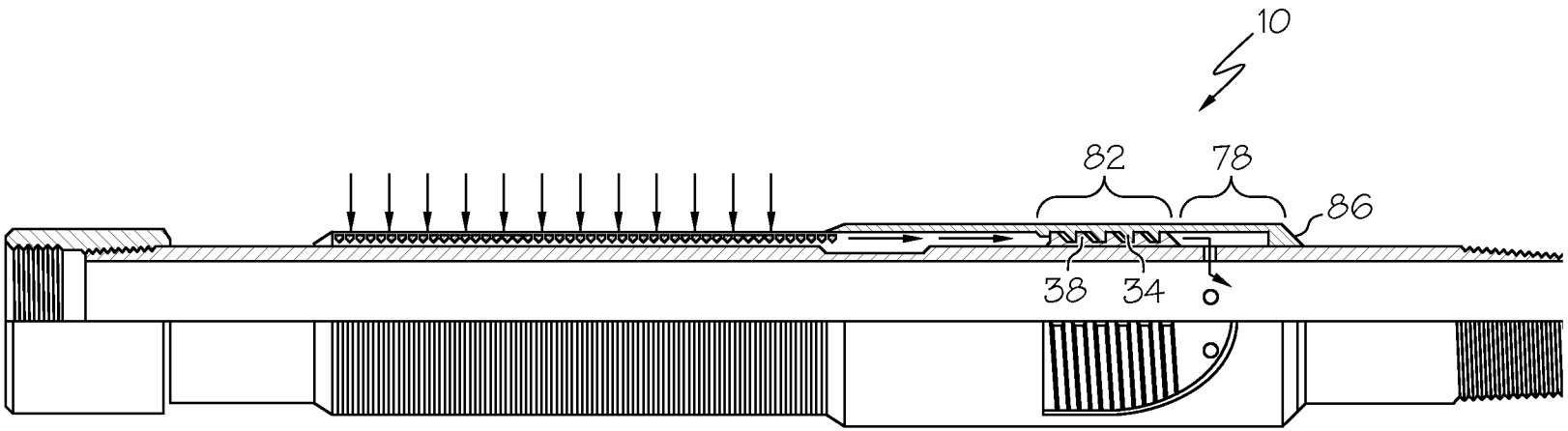
FIG. 2 depicts a cross sectional side view of the flow control device at less magnification.

Referring to FIG. 2, the flow control device 10 is shown in an embodiment wherein the movement of the first tubular member 14 is actuated by dimensional changes in the first tubular member 14. The first tubular member 14 is fabricated from a first portion 78 and a second portion 82. The threads 34 are located in the second portion 82. The first portion 78 is fixedly attached to the second tubular 18 at attachment 86 by, for example, threaded engagement, welding or similar method. The attachment 86 prevents relative motion between the two tubulars 14, 18 at the point of the attachment 86. However, relative motion between the second portion 82 and the second tubular member 18 is desirable and controllable. The first tubular member 14, including both the portions 78 and 82, are fabricated from a material having a first coefficient of thermal expansion while the second tubular member 18 is fabricated from a different material having a second coefficient of thermal expansion. The forgoing construction will result in the first tubular member 14 expanding axially at a rate, with changes in temperature, that is different than the axial expansion of the second tubular member 18. Since the fluid flow is in the annular flow spaces 22, 26 between the two tubulars 14, 18, the tubulars 14, 18 will maintain approximately the same temperature. By setting the coefficient of thermal expansion for the first tubular member 14 greater than that of the second tubular member 18, the cross sectional flow area 32 will decrease as the temperature of the flow control device 10 increases. This can be used to automatically restrict a high flowing zone in response to increases in temperature of the device 10 due to friction of the fluid flowing therethrough. Conversely, in low flowing zones, the decreased friction will maintain the device 10 at lower temperatures, thereby maintaining the cross sectional flow area 32 at larger values near the original value.

Additionally, the flow control device 10 can be used to equalize the flow of steam in a steam injection well. Portions of a well having higher flow rates of steam will have greater increases in temperature that will result in greater expansion of the first tubular member 14, thereby restricting flow of steam therethrough. Conversely, portions of the well having less flow of steam will have less increases in temperature, which will result in little or no expansion of the first tubular 14, thereby maintaining the cross sectional flow area 32 at or near its original value. This original cross sectional flow area 32 allows for the least restrictive flow of steam to promote higher flow rates. The flow control device 10 can, therefore, be used to equalize the injection of steam in a steam injection well and to equalize the recovery of hydrocarbons in a producing well.

In the forgoing embodiment, the second portion 82 was made of a material with a different coefficient of thermal expansion than the second tubular member 18. In addition to contributing to the movement of the second portion 82, this also causes a change in pitch of the thread 34 that is different than a change in pitch of the thread 38. Consequently, the cross sectional flow area 32 varies over the length of the flow path 30. Since, in the above example, the second portion 82 expands more than the second tubular member 18, the pitch of the thread 34 will increase more than the pitch of the thread 38. The cross sectional flow area 32 will, therefore, decrease more at points further from the attachment 86 than a points nearer to the attachment 86.

Keeping the cross sectional flow area 32 constant over the length of the flow path 30 can be accomplished by fabricating the second portion 82 from the same material, or a material having the same coefficient of thermal expansion, as the second tubular member 18. If the second portion 82 and the second tubular member 18 have the same coefficient of thermal expansion, then the pitch of the threads 34 will change at the same rate, with changes in temperature, as the pitch of the threads 38. Note that this constancy of the flow area 32 is over the length of the flow path 30 only, as the overall flow area 32 as a whole over the complete flow path 30 can vary over time as the temperature of the device 10 changes. Such change results when the second portion 82 moves, or translates, relative to the second tubular member 18. Movement of the second portion 82 can be achieved in several ways, with a few being disclosed in embodiments that follow.

Figure 3:
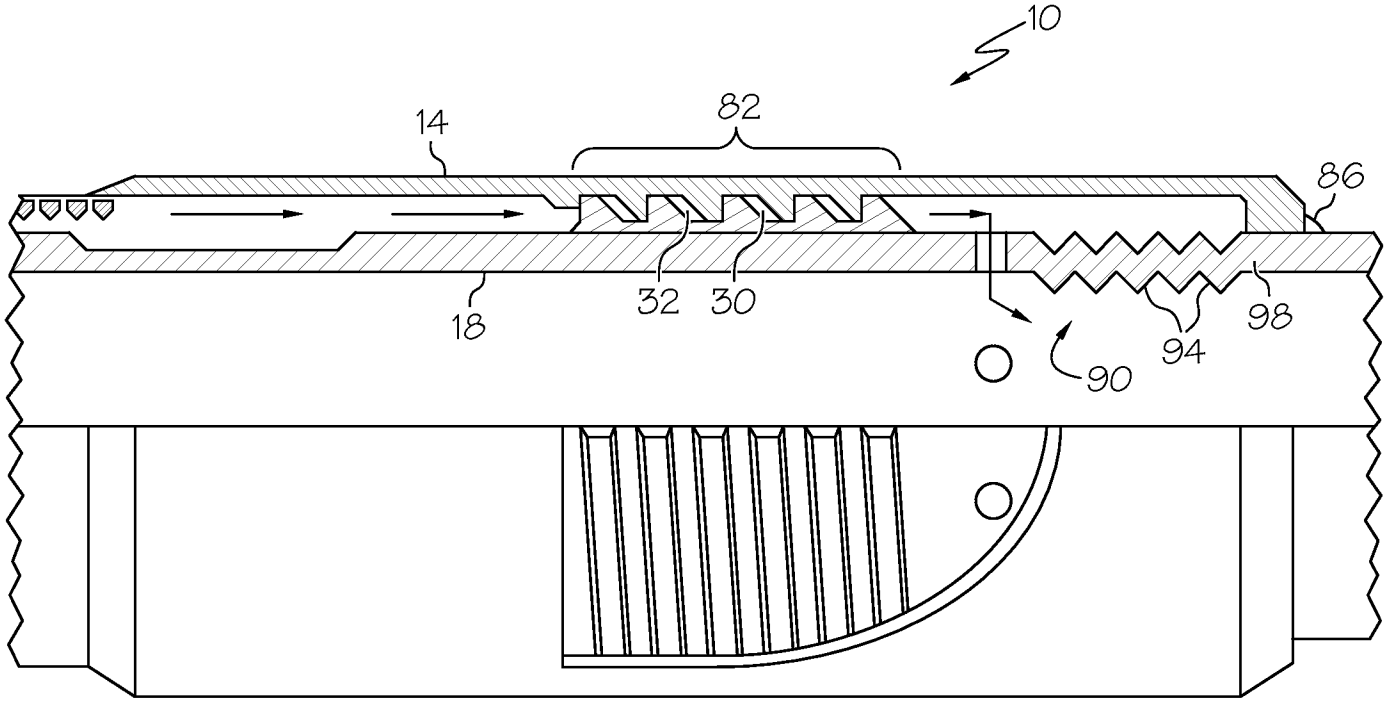
FIG. 3 depicts the flow control device of FIG. 1 with an alternate actuation mechanism.

Referring to FIG. 3, movement of the second portion 82, in this embodiment, results from expansion of the drill string in areas outside the device 10, as well as within the device 10. As portions of the drill string heat up they expand. This expansion applies an axially compressive load throughout the drill string, which includes the second tubular member 18. A crush zone 90, located in a portion of the second tubular member 18, is designed to crush and thereby shorten axially in response to the load. The crush zone 90, illustrated in this embodiment, includes a series of convolutes 94 within a perimetrical wall 98. The convolutes 94 place portions of the wall in bending that will plastically deform at loads less than is required to cause plastic deformation of walls without convolutes. Alternate constructions of crush zones can be applied as well, such as those created by the areas of weakness as disclosed in U.S. Pat. No. 6,896,049 to Moyes, for example, the contents of which are incorporated by reference herein in their entirety. The crush zone 90 is located between the attachment 86 and the second portion 82. As the crush zone 90 shortens, the threads 38 move toward the right, as viewed in FIG. 3, and in the process causing the cross sectional flow area 32 to decrease. The decrease in the flow area 32 results in an increase in the pressure drop of fluid flowing through the flow path 30 restricting flow in the process.

Figure 4A:
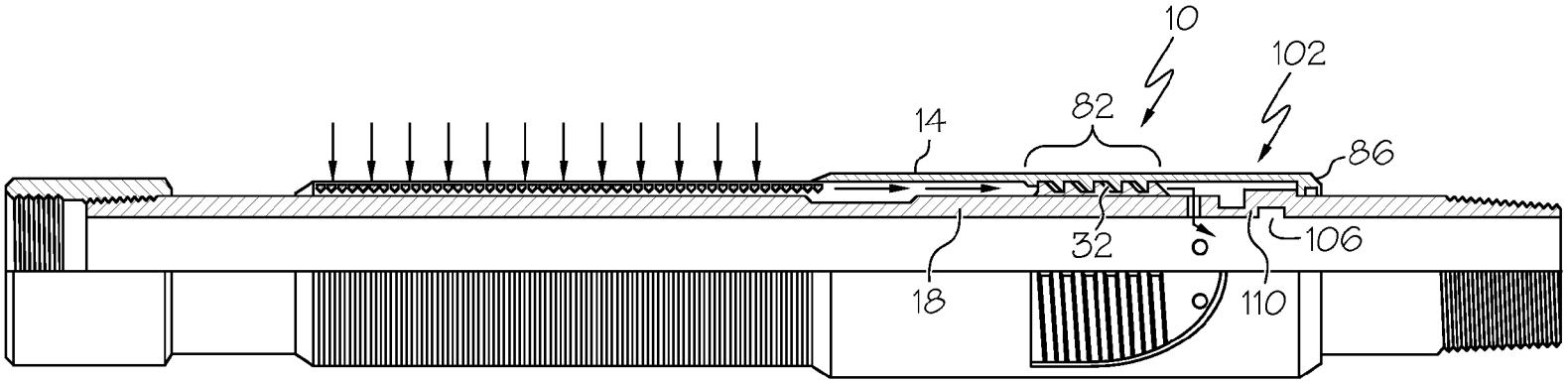
FIG. 4A depicts the flow control device of FIG. 1 with yet another actuation mechanism with the actuation mechanism in the non-actuated state.
Figure 4B:
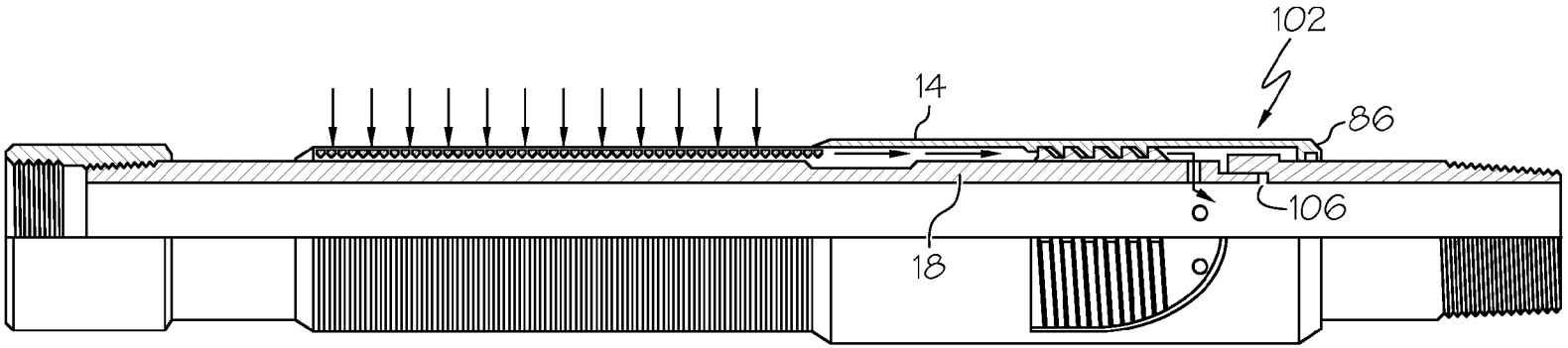
FIG. 4B depicts the flow control device of FIG. 1 with the actuation mechanism of FIG. 4A in the actuated state.

Referring to FIGS. 4A and 4B, an alternate embodiment of a crush zone 102 is employed. The crush zone 102 includes a release joint 106, such as, a shear joint, for example, having a shear plane 110 in the second tubular 18. The shear plane 110 shears at a selected level of compressive load. Upon shearing, the shear joint 106 is axially shortened. By placing the shear joint 106, between the attachment 86 and the second portion 82, the cross sectional flow area 32 is made to decrease upon axial shortening of the shear joint 106, as depicted in FIG. 4B.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A flow control device, comprising:

a first member defining a first portion of a cross section of a flow path;

a second member defining a second portion of the cross section of the flow path, the second member being distinct from and operably coupled with the first member, the flow path having a cross sectional flow area defined at least partially by the first portion and the second portion, a length of the flow path being greater than a largest dimension of the cross sectional flow area, and the cross sectional flow area being adjustable by axial movement of at least a portion of the first member relative to the second member; and a crush zone arranged with at least one of the first member and the second member that can change in length due to loading thereof, at least a portion of the crush zone being configured to undergo plastic deformation due to the loading thereof and resulting in the movement of at least a portion of the first member relative to the second member.

2. The flow control device of claim 1, wherein the cross sectional flow area is altered at every point along the flow path in response to the movement.

3. The flow control device of claim 1, wherein the first member is tubular with a radially inwardly protruding thread and the second member is tubular with a radially outwardly protruding thread and the radially outwardly protruding thread extends radially outwardly a dimension greater than a minimum dimension of the radially inwardly protruding thread.

4. The flow control device of claim 3, wherein clearance between the radially inwardly protruding thread and the radially outwardly protruding thread defines the flow path.

5. The flow control device of claim 1, wherein a plurality of the flow control devices are incorporated in a well to equalize at least one of injection of steam and production of hydrocarbons along the well.

6. The flow control device of claim 1, wherein the at least one crush zone changes in axial length in response to axial loading thereof.

7. The flow control device of claim 1, wherein the at least one crush zone includes at least one shear joint.

8. The flow control device of claim 1, wherein the crush zone includes at least one convolute.

9. The flow control device of claim 1, wherein the device is arranged downhole.

10. A flow control device, comprising:

a first member defining a first portion of a cross section of a flow path;

a second member defining a second portion of the cross section of the flow path, the second member being distinct from and operably coupled with the first member, the flow path having a cross sectional flow area defined at least partially by the first portion and the second portion, a length of the flow path being greater than a largest dimension of the cross sectional flow area and the cross sectional flow area being adjustable by movement of at least a portion of the first member relative to the second member; and a crush zone arranged with at least one of the first member and the second member that can change in length due to loading thereof, at least a portion of the crush zone being configured to undergo plastic deformation due to the loading thereof and resulting in the movement of at least a portion of the first member relative to the second member, wherein the flow path has a helical shape.

11. A method of adjusting restriction of a flow path, comprising:

porting fluid through the flow path, the flow path having a length greater than a largest dimension of a cross sectional area of the flow path; and altering the cross sectional area of the flow path by loading a crush zone to plastically deform at least a portion of the crush zone thereby changing an alterable length of the crush zone, the crush zone arranged with at least one of a first member defining a first portion of a cross section of the flow path and a second member, distinct from and operably coupled with the first member, defining a second portion of the cross section of the flow path, the loading of the crush zone resulting in axial movement of the first member relative to the second member such that the cross sectional area is altered.

12. The method of adjusting restriction of a flow path of claim 11, further comprising shortening the crush zone arranged with the at least one of the first member and the second member.

13. The method of adjusting restriction of a flow path of claim 12, wherein shortening the crush zone includes compressing at least one convolution of the crush zone.

14. The method of adjusting restriction of a flow path of claim 12, wherein shortening the crush zone includes shearing at least one shear joint of the crush zone.

15. The method of adjusting restriction of a flow path of claim 11, wherein loading the crush zone includes axially loading the crush zone.

16. The method of adjusting restriction of a flow path of claim 11, further comprising arranging a tubular string containing the first member and the second member downhole.

* * * * *